United States Patent [19]

Fischer

[11] 4,241,659

[45] Dec. 30, 1980

[54] SHEET TRANSFER APPARATUS FOR ROTARY PRINTING MACHINES HAVING SERIALLY ARRANGED PRINTING STATIONS

[75] Inventor: Hermann Fischer, Augsburg, Fed. Rep. of Germany

[73] Assignee: Maschinenfabrik Augsburg-Nürnberg Aktiengesellschaft, Augsburg, Fed. Rep. of Germany

[21] Appl. No.: 909,435

[22] Filed: May 25, 1978

[30] Foreign Application Priority Data

Jun. 1, 1977 [DE] Fed. Rep. of Germany ..... 2724621

[51] Int. Cl.[3] ..... B41F 21/04; B41F 7/04

[52] U.S. Cl. ..... 101/231; 101/230; 101/409; 271/82; 29/117

[58] Field of Search ..... 29/117; 226/114; 271/80, 82, 277; 101/230-232, 407, 183

[56] References Cited

U.S. PATENT DOCUMENTS

| | | | |
|---|---|---|---|
| 2,586,300 | 2/1952 | Campbell | 29/117 |
| 2,892,630 | 6/1959 | Schunemann | 271/82 |
| 2,933,039 | 4/1960 | Claybourn et al. | 101/183 |
| 3,654,861 | 4/1972 | Rudolph et al. | 101/409 |
| 3,772,990 | 11/1973 | Weisgerber | 101/230 |
| 3,796,154 | 3/1974 | Weisgerber | 101/409 |
| 4,015,522 | 4/1977 | Preuss et al. | 101/183 |
| 4,099,463 | 11/1978 | Zimmerman | 101/230 |

FOREIGN PATENT DOCUMENTS

| | | | |
|---|---|---|---|
| 901115 | 7/1945 | France | 29/117 |

*Primary Examiner*—William Pieprz

*Attorney, Agent, or Firm*—Frishauf, Holtz, Goodman & Woodward

[57] ABSTRACT

To permit reversal of sheets having extended length, a sheet storage or sheet transfer drum in engagement with a sheet reversal drum is formed with a sheet displacement apparatus located on the sheet storage drum rearwardly—with respect to the direction of rotation thereof—of the gripper means of the sheet storage drum and operable to lift a sheet off the circumference of the storage drum; the sheet displacement means preferably is a rail extending axially across the width of the storage drum which can swing from a circumferential position on the storage drum to an extended position, under control of a fixed cam thus, effectively, shortening the length of the overlap of a sheet on the storage drum on the circumference thereof and permitting handling of longer sheets thereby. The extension of the sheet displacement means is carried out at a position when the displacement means are out of engagement or interference with any adjacent cylinder.

10 Claims, 5 Drawing Figures

Figure 1:
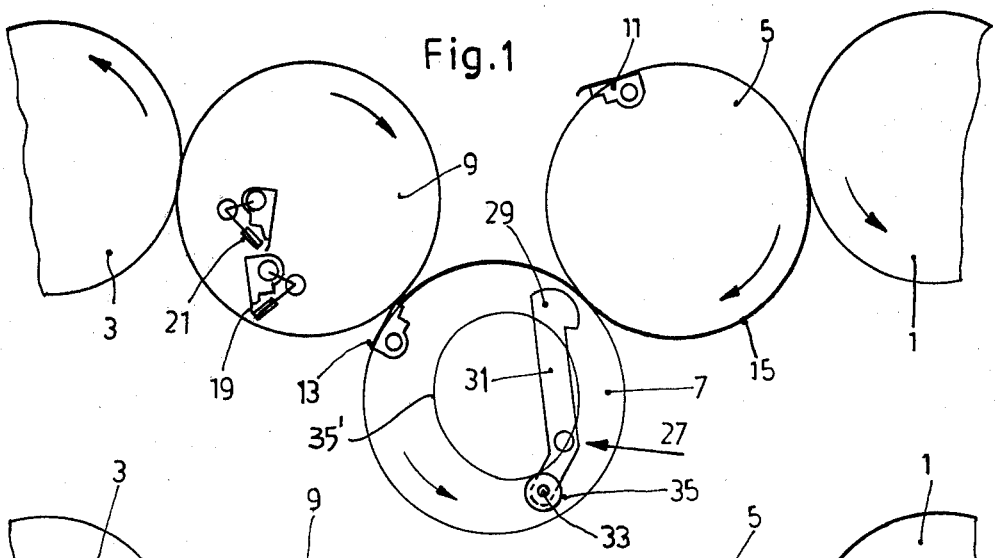

SHEET TRANSFER APPARATUS FOR ROTARY PRINTING MACHINES HAVING SERIALLY ARRANGED PRINTING STATIONS

The present invention relates to rotary printing machines, and more particularly to an apparatus and system to transfer single sheets between printing stations of rotary printing machines, for example rotary offset printing machines.

BACKGROUND AND PRIOR ART

Many rotary offset printing machines have serially arranged printing stations in which sheets from a first printing station are transferred to a storage drum and then over another drum to a second serially arranged printing station. The other drum can be so arranged that the sheet is transferred either in its normal course of movement, or turned end-for-end, so that a previously printed page will always be uppermost, or respectively inverted with respect to the drum. Such a drum is referred to as a reversal drum since, selectively, the sheet can be transferred straight or reversed. This is obtained by gripping either the forward edge of the sheet being transferred, or the rearward edge, so that the sheet on the reversal drum will then continue to be fed in either upward or turned-over position.

Sheet reversal devices of this type have been described in the literature see, for example, U.S. Pat. No. 3,796,154, Weisgerber, to which German Patent Document DE-AS 2,133,693 corresponds. The overall arrangement then permits single-sided printing in multiple colors by the serially arranged printing stations, or serial printing on both sides of the sheet.

Sheet reversal apparatus of the known type are so arranged that the storage drum has double the diameter of the plate cylinders of the printing stations so that, upon reversal, the storage drum can accept printed sheets having a format which exceeds the printed space defined by the geometric arrangement of the transfer drum. The increased diameter of the storage drum not only requires additional space in the printing machine and, since the storage drum will require two sheet gripper systems, substantial additional costs in manufacture and eventual maintenance, but additionally requires extremely accurate sheet feeding to prevent differences in match and alignment of the sheet with respect to the serially arranged printing stations, since the printed sheet must be transported over two different sheet gripping systems.

The Invention

It is an object to decrease the size of serially arranged rotary sheet printing machines in which the storage and transfer drum need have only the diameter of the plate cylinder which, in turn, is matched to the length of a single sheet thereon and yet is capable of handling printed sheets having a length which exceeds the length, or arc of the portion of the storage drum which is located between the contact points of the storage drum and the adjacent cylinders or drums.

Briefly, the storage and transfer drum includes a sheet displacement means located thereon rearwardly—with respect to the direction of rotation—of the storage drum grippers which grip the forward edge of the sheet. The sheet displacement means is operable to be lifted off the circumference of the storage drum and thereby lift at least a portion of the sheet from the storage drum circumference. The edge of the sheet remote from that being gripped thus can slip forwardly with respect to its engaged circumferential position with the drum, that is, will be closer to the storage and transfer drum gripper means than when the sheet is in engagement with the entire circumference of the storage and transfer drum.

The sheet reversal system, including the storage and transfer drum, can then be constructed in with substantially smaller space and be, cheaper, and still be more reliable in operation. Better printing results and better alignment can be obtained, all other conditions being equal. The system has the additional advantage that the instant of time in which the sheet gripper system of the storage and transfer drum must open upon further transport of a turned end-over-end sheet becomes essentially independent of the format of the sheet to be printed. Prior art structures of sheet reversal arrangements (see, for example, DDR (East German) Patent DL PS 57 345) require systems which are substantially more complex and hence subject to malfunction.

In a preferred and simple form of the invention, the sheet displacement means is merely a rail or rod extending over the width of the storage drum and movable away from the circumference thereof by means of two axially diametrically located arms which pivot back and forth, to lift the rail out of the circumference, or place it within or on the circumference of the storage drum. The arms, preferably, are formed as double levers, one end of which carries the rail and the other end carries a cam roller or cam follower which is in engagement with a fixed cam, controlling the position of the arms with respect to the circumference of the drum and hence the position of the rail with respect to the circumference of the drum. The cam itself, preferably, is adjustable in rotary position about the axis of the storage drum. The cam and the cam followers can be constructed in suitable and well known manner, engagement between cam and cam follower being assured by springs, or the like.

Drawings, illustrating a preferred example, wherein:

FIGS. 1–5 are highly schematic side views of a multistation, serially arranged printing machine, the respective FIGS. 1–5 being similar and showing the system in sequential stages of operation so that the sequence and position of sheets as they pass through the system will be clear.

The printing machine has two printing stations, shown in the drawings only in fragmentary form and illustrating by the fragmentary drums 1, 3 the counter cylinders against which a sheet is placed for printing by means of a printing cylinder, an offset blanket or the like, in engagement with cylinders 1, 3, with a sheet 15 therebetween. The first counter cylinder 1 is in engagement with an intermediate cylinder 5 which leads a sheet 15 to a storage and transfer cylinder 7. A cylinder 9 which can operate in transport or reversal mode is located between the storage and transfer drum 7 and the counter cylinder 3 of the next subsequent printing stage. The center of rotation of drum 7 is offset with respect to the shafts of cylinders 5 and 9. The diameters of the cylinders and drums 1, 3, 5, 7, 9 is the same, and can accommodate a single sheet during the revolution. (see FIG. 1).

The intermediate or auxiliary cylinder 5 and the storage cylinder 7 each have a single set of a sheet gripping systems 11, 13 of known and for example standard construction in which subsequent printing sheets 15, 17 can be gripped. The sheets 15, 17 follow each other on the circumference of the cylinders with little space therebetween. The transport and reversal drum 9 has two gripper systems 19, 21, of which only the gripper system 19 is used if sheets are normally to be transferred by the drum or cylinder 9, that is, without reversal; whereas, upon reversal, the gripper system 21 grips the trailing end of the sheet for subsequent transfer to the gripping system 19.

Sheets which are to be transferred normally, that is, without reversal, are gripped by the gripper 11 of the continuously rotating intermediate drum 5, being received from the continuously rotating counter drum 1. The sheet is then transferred to the gripper system 13 of the continuously rotating storage drum 7 as seen in FIG. 1. It is then transferred to the gripper system 19—FIG. 1—and transferred to the continuously rotating counter cylinder 3 with printed side up, that is, without reversal; the number of cylinders, as shown in the drawing of FIG. 1, then would place the printed side upwardly.

Sheets to be reversed, if the sheets are of sufficiently short format, are received as before from the counter cylinder 1 by gripper system 11 of drum 5 and transferred to the storage cylinder 7, held at the front edge by the grippers 13. The printed sheet 15 continues to be gripped by the grippers 13 of storage drum 7, however, on and beyond the position shown in FIG. 1 until the trailing edge—see FIG. 2—has reached the engagement line or tangential line between the storage drum 7 and the reversal cylinder 9. The grippers system 21 of reversal drum 9 then will grip the trailing edge of the printed sheet 15, the gripper system 13 of storage drum 7 releases the front edge of the printed sheet and the gripper system 21 can pull the sheet into the interior of the reversal cylinder 9, as illustrated in FIG. 3. The sheet, with the gripped edge within the cylinder 9, is then transferred with the same edge to the gripper system 19. The gripper system 19 is moved to the outside circumference of the cylinder—see FIG. 4—and now pulls the printed sheet 15 in a direction counter to its previous movement; the sheet has been turned over and, assuming that its upper side had been printed in the printing station 1, now will have that printed side facing the circumference of the cylinder 3. It can then be transferred to the gripper system 23 of the counter cylinder 3—see FIG. 5.

Figure 2:
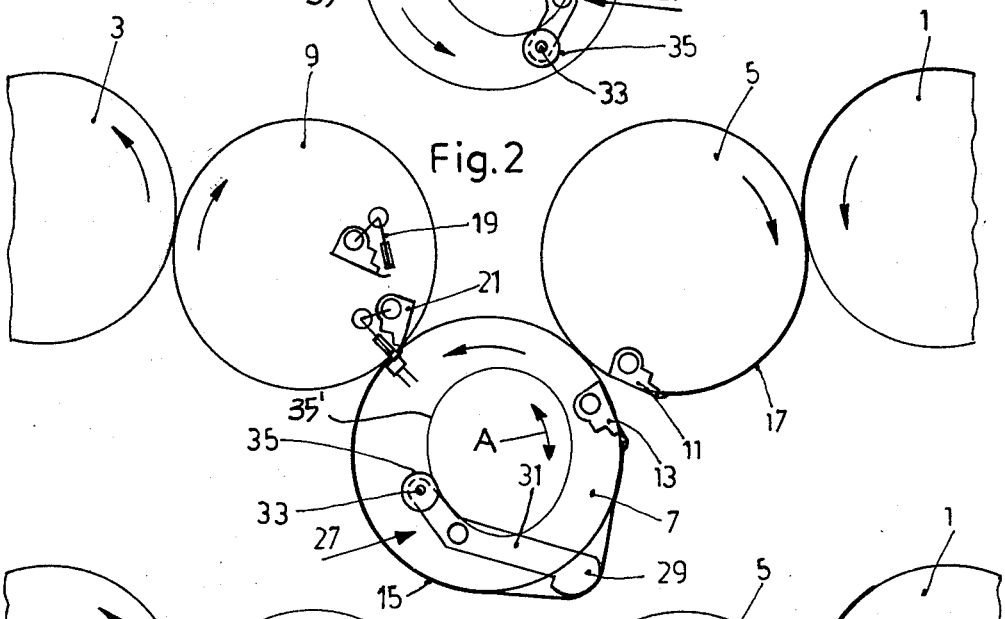
Figure 3:
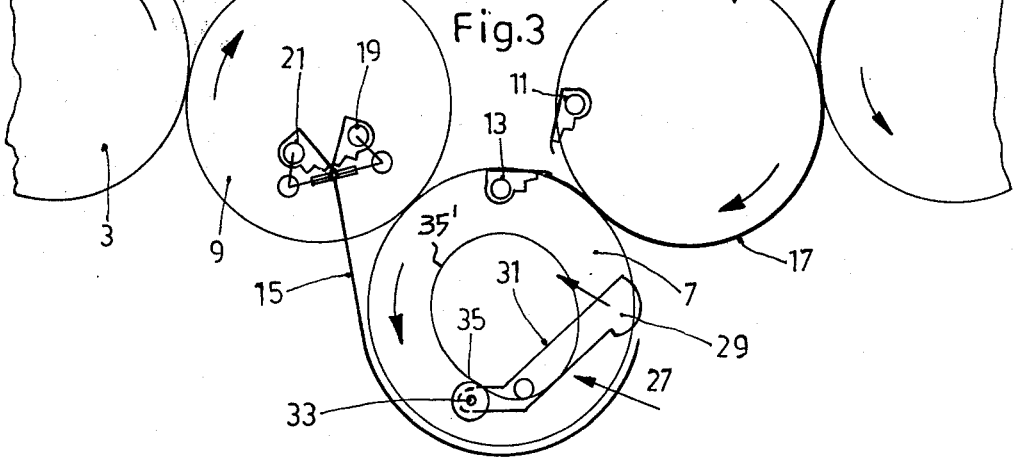
Figure 4:
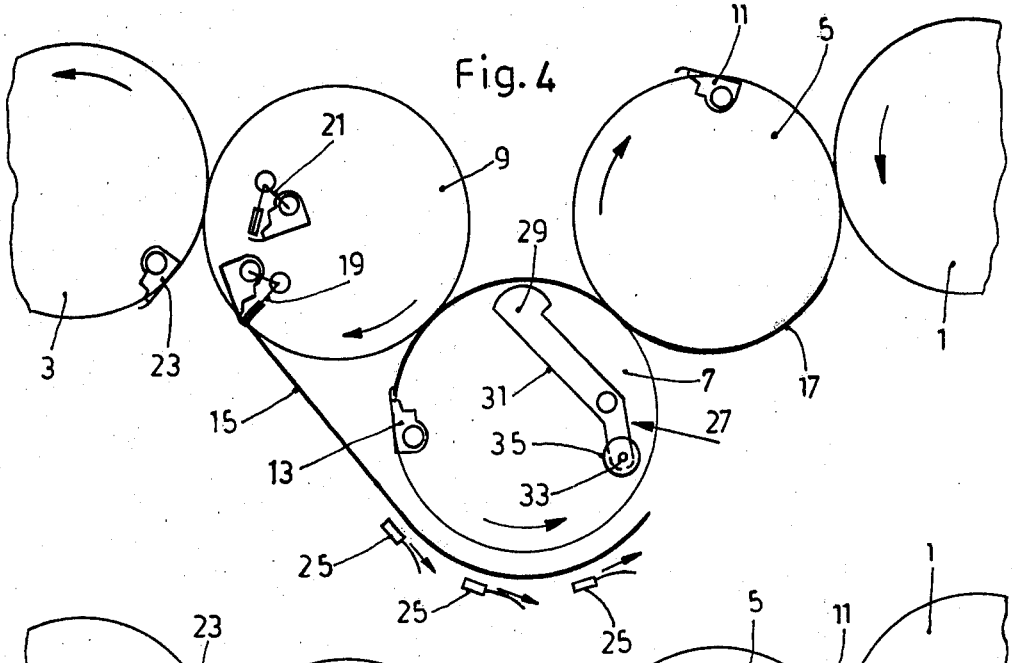
Figure 5:
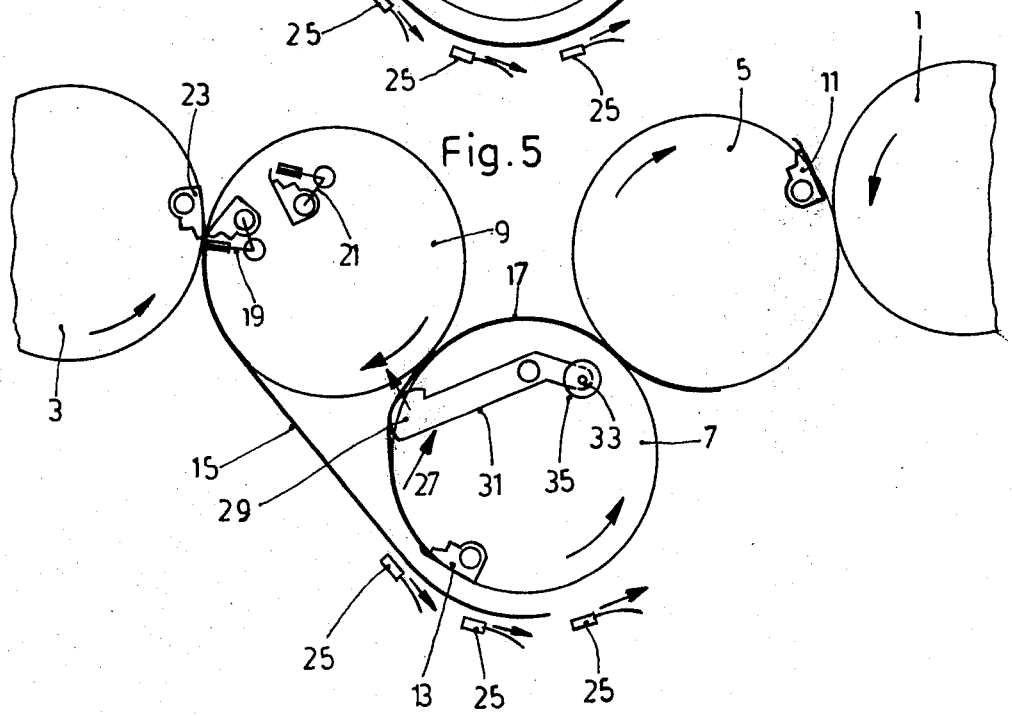

A second printed sheet 17—see FIGS. 2–4—follows closely after the first printed sheet 15. The second sheet 17, transported on the intermediate cylinder 5, is transferred to the gripper system 13 of the storage drum 7 shortly after the grippers 13 have released the front edge of the previous sheet 15. The grippers 13 then will guide the sheet around the storage drum 7—see FIG. 4. A plurality of air nozzles 25 are provided to prevent adhesion and overlap of two sequential sheets 15, 17 which are, for example, in the position of FIG. 5. The nozzles 25 direct air blasts against the sheet in the direction of rotation of the drum so that they cause a vacuum which stiffens the printed sheet 15, and cause the sheet 15 to lift off the storage drum 7.

The system as described can store only a single length of sheet without further arrangements, corresponding to that portion of the circumference of the drum which lies between the engagement point with the reversal cylinder 9 and with the intermediate drum 5; referred to FIG. 2, the maximum length of sheet which can thus be handled corresponds approximately to the length of the circumference between the gripper system 11 of auxiliary drum 5 and the gripper system 21 on reversal drum 9. It is necessary that the gripper system 13 on the storage drum 7 release a sheet 15 held thereon in order to be capable of accepting a subsequent sheet 17; the gripper system 21 on reversal drum 9 must grip the sheet 15 on the storage cylinder 7 at approximately the same time. This length of sheet is clearly shorter than the maximum length of sheet which can be wrapped around the lower portion of the storage drum 7.

In accordance with the present invention, the length of sheet capable of being handled by the storage drum 7 can be substantially increased by placing a sheet displacement means on the storage drum 7. The sheet displacement means is operable to selectively lift the sheet 15 off the storage drum 7 at selected angular positions of the drum 7 and within the largest angular range between cylinders 5 and 9, thereby effectively increasing the diameter of the storage drum 7, as best seen, for example, in FIG. 2.

The sheet displacement means 27 is a rail or rod 29 extending axially across the width of the storage drum 7 and held at both its ends in two similar arms 31, of which only one is seen in the end views of the drawings. The arms 31 are eccentrically journalled in the interior or adjacent the facing edge of the storage drum 7 in such a manner that the rail 29 can be lifted off from a circumferential position on the storage drum 7. This causes a sheet 15—see FIG. 2—to be lifted off the circumference of the storage drum 7, and the sheets will then assume a shape which has a triangular bulge, the legs of which have a substantially greater length than the length of the circumference of the drum 7 included in the angle between the legs of that triangle. Consequently, the trailing edge of sheet 15 is moved forwardly—with respect to the direction of rotation of drum 7—by a corresponding distance. The sheet displacement mechanism thus, effectively, increases the diameter of the storage drum 7, although only at selected times and under selected conditions.

The displacement mechanism 27 is pivoted or rocked backwardly into circumferential alignment with the drum 7 upon reception of the next subsequent printed sheet 17—see FIGS. 1, 4. Arms 31, preferably, are constructed as double-levers carrying at one end the rail 29 and at the other a stub shaft 33 which carries a cam follower roller 35 extending to the lateral facing walls of the printing machine and in engagement with a control cam 35'. Control cam 35' is shown only in FIGS. 1–3 for simplicity of drawing and better understanding.

The extent to which the sheet displacement mechanism 27 moves the rail 29 out of the circumference of the storage drum 7 can be fixed for simplicity of construction. The extent of deflection out of the circumference determines the effective shortening of the sheet 15 at its rear, or trailing edge. Matching of the extent of projection to specific lengths of sheet so that the rear edge of the sheet can be gripped by grippers 19, 21 or cylinder 9 can readily be obtained by constructing the cam for a maximum deflection and making the cam adjustable or, for example, mounting it in such a way that it can be rotated or rocked, see arrow A, (FIG. 2) about the axis of the storage drum 7. The cam, with that construction, is then preferably so arranged that it provides for maximum lift-off from the circumference of the drum in one position, and permits lesser lift-off upon rotation. That portion of the lift-off of the cam which is not used for a specific sheet can then be placed in a position where a sheet is not engaged at all, that is, without effect on the printed sheet 15, so that the cam will cause lift-off to the maximum extent at an instant of time when the sheet on storage drum 7 has already been released by the associated gripper system 13.

The drawings, FIGS. 1 to 3, illustrate a usual printing system in which three intermediate drums 5, 7, 9 are placed between cylinders 1, 3 of serially located printing stations. Generally, three such cylinders and drums are used because printing stations are often physically separated from each other by a distance requiring a plurality of transfer drums or cylinders. If the distance between printing stations is very small, however, only a single transfer drum is needed. The intermediate drum 5 is then not used and its function is taken over by the counter cylinder 1. The counter cylinder 3 is then constructed with gripper systems similar to the gripper systems 19, 21 of the transport and reversal drum 9 so that the counter cylinder 3 will, effectively, operate as a reversal cylinder as well. The only remaining drum then will be drum 7, constructed as described with the displacement mechanism 27. The engagement of the gripper system 21 with respect to drum 31 can then be selected as desired.

Control of the various grippers 11, 13, 19, 21 which, by themselves, can be constructed as is customary, can likewise be obtained, as customary, for example by cams. Since the gripper systems and their control are known, they are illustrated only schematically; their cooperation with the sheet displacement mechanism is clear from the sequential illustration in the drawings.

Various changes and modifications may be made within the scope of the inventive concept.

I claim:

1. In a rotary printing maching having serially arranged printing stations (1, 3) including printing cylinders having a circumference accepting a single sheet thereon, a sheet transfer apparatus including sheet reversal means located between two printing stations comprising the combination of a continuously rotating sheet storage and transfer drum (7) of approximately the same diameter as said cylinders including storage drum gripper means (13) engageable with the front edge of a sheet transferred thereto; and a sheet transport drive reversal cylinder (9) located downstream of the storage drum (7) including reversal gripper means (19, 21) selectively engageable with the front edge or the rear edge of a sheet located on the storage and transfer drum (7) for transfer to the sheet transport and reversal drum (9), selectively, either in the same orientation or turned over; with sheet displacement means (27) located on the sheet storage and transfer drum (7) rearwardly—with respect to the direction of rotation thereof—of the storage gripper means (13) and movable between a position corresponding to the circumference of the storage and transfer drum and a position lifted off the circumference of the storage and transfer drum and thereby lift at least a portion of the sheet (15) on the storage drum off at least a portion of the circumference thereof;

and means (35, 35') controlling movement of said sheet displacement means during rotation of the storage and transfer drum (7) to selectively locate the position of the rear edge of the sheet (15) remote from the gripped edge to be closer to the front edge gripped by the storage and transfer drum gripper means (13) at selected angular positions of the storage drum than when the sheet is in engagement with the entire circumference of the storage drum.

2. Apparatus according to claim 1, wherein the sheet displacement means (27) comprises a rail or bar (29) extending axially across the width of the storage drum (7) adjacent its circumference;

and position-controlled support arms (31) in engagement with with said rail or bar and positioned on the storage drum (7) to selectively move the rail or bar between a position essentially flush with the circumference of the storage drum (7) and a position lifted off the circumference of the storage drum and projecting therefrom.

3. Apparatus according to claim 2, wherein the support arms (31) comprise double-arm levers carrying the rail or bar (29) at one lever arm;

and the movement control means comprises a cam follower (33, 35) carried at the end of the other lever arm and a non-rotating cam (35) positioned on the machine in engagement with the cam followers and controlling movement of the arms between said positions.

4. Apparatus according to claim 3, wherein the cam is pivotable about the axis of the storage drum (7).

5. Apparatus according to claim 1, further comprising differential air pressure nozzles (25) located with respect to the storage drum (7) in a region remote fom the tangential engagement of the storage drum (7) with the sheet reversal drum (9) and positioned to provide a differential air pressure acting on a sheet (15) in the region of that end thereof which has been released by the storage drum gripper means (13) after having been gripped by the reversal drum gripper means (21) and tending to lift said end off the circumference of the storage drum.

6. Apparatus according to claim 1, including an intermediate drum (5) in engagement with one of the cylinders of the trailing printing station of said sequentially arranged printing stations;

and wherein the intermediate drum (5), the storage drum (7) and the sheet reversal drum (9) all have essentially the same diameter as the cylinders (1, 3) of the printing stations.

7. Apparatus according to claim 1, wherein the sheet transport and reversal cylinder (9) forms a portion of the leading printing station of said sequentially arranged printing station;

and the diameters of the printing cylinders (1, 3) of the leading and the trailing stations, the transport and reversal cylinder, and the sheet reversal drum (7) are approximately the same.

8. Apparatus according to claim 7, further comprising differential air pressure nozzles (25) located with respect to the storage drum (7) in a region remote from the tangential engagement of the storage drum (7) with the sheet reversal drum (9) and positioned to provide a differential air pressure acting on a sheet (15) in the region of that end thereof which has been released by the storage drum gripper means (13) after having been gripped by the reversal drum gripper means (21) and tending to lift said end off the circumference of the storage drum.

9. Apparatus according to claim 1 wherein the center of rotation of said storage and transfer drum (7) is offset with respect to a line connecting the centers of rotation of the cylinders with which it is in contact, and wherein said angular position is within the largest angular range which falls between the contact position of said transfer and storage drum with the adjacent cylinders.

10. Apparatus according to claim 1 wherein the displacement control means (35, 35') controls the degree of displacement of the rear edge of the sheet to be in a position to be gripped by the reversal gripper means (19, 21) of the transport and reversal cylinder (9) when said reversal gripper means are selected for engagement with the rear edge to reverse and transport a sheet being transferred from the transfer and storage drum (7).

* * * * *